US006188169B1

(12) United States Patent
Takayanagi

(10) Patent No.: US 6,188,169 B1
(45) Date of Patent: Feb. 13, 2001

(54) APERTURE GRILL SUPPORTING FRAME AND MANUFACTURING METHOD THEREOF

(75) Inventor: Kenichiro Takayanagi, Kanagawa (JP)

(73) Assignee: Sony Corporation, Tokyo (JP)

( * ) Notice: Under 35 U.S.C. 154(b), the term of this patent shall be extended for 0 days.

(21) Appl. No.: 09/004,913

(22) Filed: Jan. 9, 1998

(30) Foreign Application Priority Data

Jan. 10, 1997 (JP) ..... 9-003370

(51) Int. Cl.[7] ..... H01J 29/81
(52) U.S. Cl. ..... 313/407; 313/402
(58) Field of Search ..... 313/402, 403, 313/406, 407

(56) References Cited

U.S. PATENT DOCUMENTS 4,780,641 * 10/1988 Hashiba et al. ..... 313/407 X
5,382,871 * 1/1995 Funahashi et al. ..... 313/407 X
5,525,859 * 6/1996 Ito et al. ..... 313/407 X
5,672,935 * 9/1997 Ito et al. ..... 313/407

* cited by examiner

*Primary Examiner*—Ashok Patel
(74) *Attorney, Agent, or Firm*—Ronald P. Kananen; Rader, Fishman & Grauer

(57) ABSTRACT

This invention intends to provide an aperture grill supporting frame whereby forces exerted by damper wires on individual thin tapes constituting an aperture grill are uniform. This object is achieved by the following: the surfaces for welding of upper and lower frames of an aperture grill supporting frame are so processed from the beginning as to have sizes compensatory for deformations occurring as a result of pressurization and thus they will form a part of a columnar wall surface with a radius of R when they subject to deformations in the presence of a pressure. Thus, the surfaces for welding at both ends, for example, take a slightly bulged form as compared with a sector of a radius of R before they are subject to welding.

7 Claims, 6 Drawing Sheets

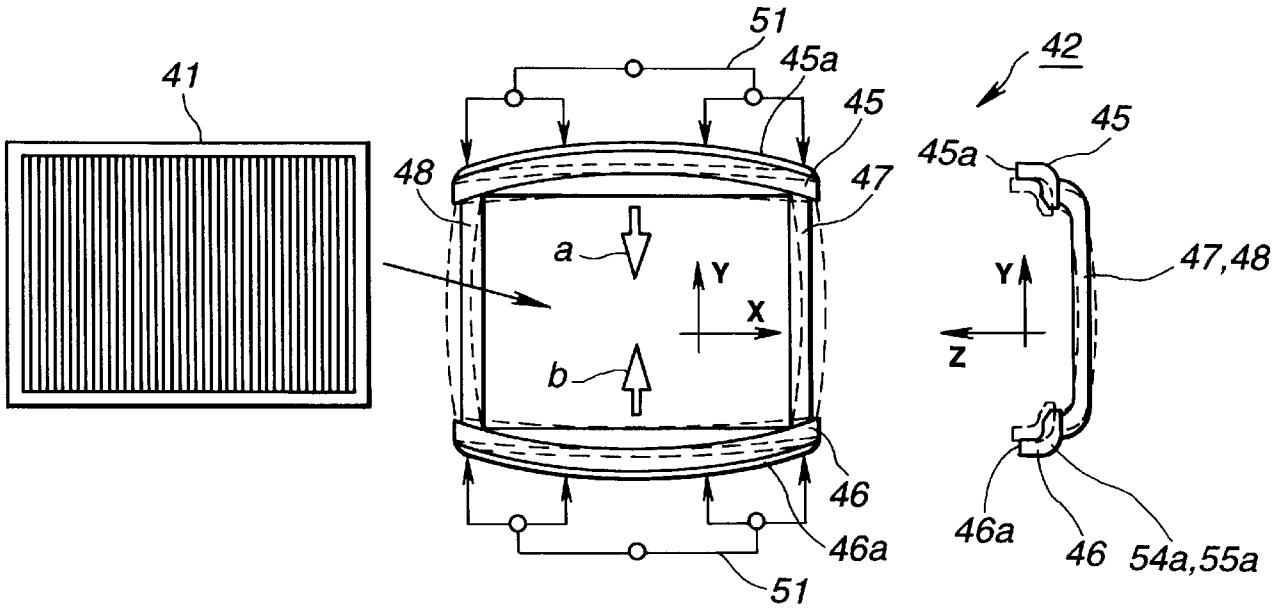
FIG.1B
FIG.1A
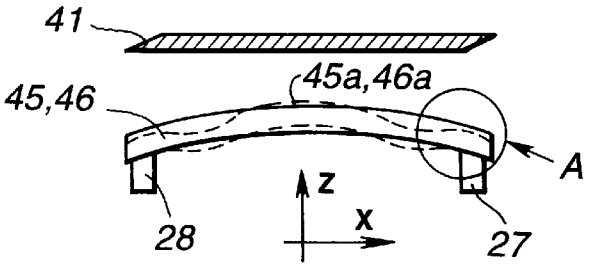
FIG.1C

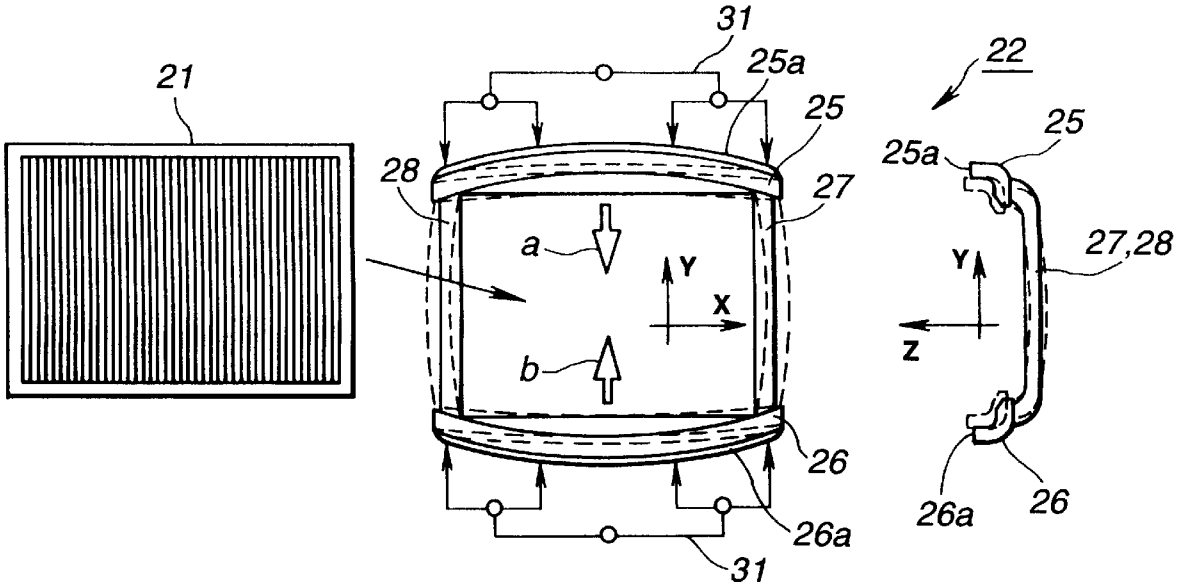
FIG.6A
FIG.6B
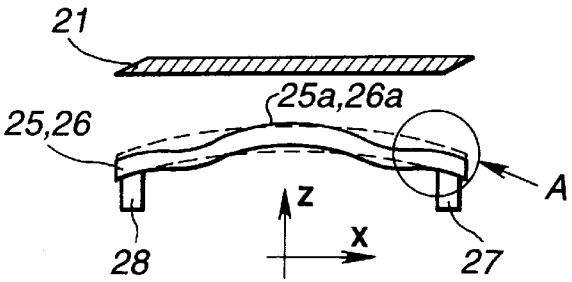
FIG.6C

APERTURE GRILL SUPPORTING FRAME AND MANUFACTURING METHOD THEREOF

BACKGROUND OF THE INVENTION

1. Field of the Invention

This invention relates to an aperture grill supporting frame and a method for manufacturing thereof, more particularly to an aperture grill supporting frame which is used for an in-line cathode ray tube to support an aperture grill with a grid of longitudinal slits.

2. Prior Art

To take an example, the television receiver incorporates a cathode ray tube. As such cathode ray tube, the in-line cathode ray tube is well known in which three electron beams are arranged to be in-line, namely, arranged to form a row in a horizontal direction.

This in-line cathode ray tube is provided with a three-beam electron gun based on unit electron guns to emit three electron beams which are arranged in a horizontal line, a convergence electrode to converge the electron beams emitted from the electron gun, a deflecting yoke to deflect the electron beams, a color sorting mechanism having an aperture grill with a grid of longitudinal slits, and a glass bulb which has a phosphor screen which has its surface coated in longitudinal parallel lines with phosphors giving red, green and blue lights.

With this cathode ray tube, the electron beams emitted from the electron gun, after having been converged by the convergence electrode, are deflected by the deflecting yoke in horizontal and vertical directions in synchrony with horizontal and vertical synchronization signals, and are scanned over the whole surface of the phosphor screen.

The electron beams which have been deflected by the deflecting yoke have their unnecessary portion masked by the color sorting mechanism. Namely, the color sorting mechanism passes only the fraction of electron beams which have been designed to be directed onto the phosphor screen. The electron beams having passed the color sorting mechanism properly strike against red, blue and green phosphors, causing them to illuminate to display a color image on the screen.

The color sorting mechanism consists of an aperture grill with a grid of longitudinal slits, an aperture grill supporting frame which supports the aperture grill by stretching it in a horizontal direction, damper wires which are placed in contact with thin tapes constituting the aperture grill to give them axially acting forces, and damper springs which stretch both ends of damper wires.

FIG. 1 illustrates the aperture grill supporting frame 42 and aperture grill 41. FIG. 1A gives a frontal view of the aperture grill supporting frame 42 and aperture grill 41, FIG. 1B a lateral view of the aperture grill supporting frame 42, and FIG. 1C a bottom view of the aperture grill supporting frame 42 and aperture grill 41.

The aperture grill 41 is produced after a rolled plate material has been subject to photoetching to produce slits in the form of a grid of longitudinal lines, and parts between adjacent slits are occupied by thin tapes. Namely, the aperture grill 41 takes the form of an assembly of thin tapes. As will be described later, this aperture grill 41 is welded, while being kept stretched in a vertical direction or in a Y-axis direction, to the aperture grill supporting frame 42. The damper wires are made of, for example, tungsten wire, and are placed such that their direction is normal to the long axes of the slits of the aperture grill 41. Both ends of these damper wires are stretched by damper springs mounted to the aperture grill supporting frame 42. By virtue of the tension from the damper springs, the damper wires are placed in contact with individual thin tapes constituting the aperture grill 41 to give a vertically acting force to each of the thin tapes. Thus, the damper wire prevents the thin tapes of aperture grill 41 from being put into vibration by, for example, a certain external vibrating source, through the friction generated by their contact with individual thin tapes. Namely, the damper wires exert a uniformly acting anti-vibration effect on the whole surface of the aperture grill 41 by giving uniformly acting forces on individual thin tapes of the aperture grill 41.

The aperture grill supporting frame 42 consists of upper and lower frames 45 and 46 which together support the aperture grill 41 by stretching it in a horizontal direction, and side frames 47 and 48 which are connected to the upper and lower frames 45 and 46 at their ends. The upper and lower frames 45 and 46 have a cross-section in the form of an inverted L as shown in FIG. 1B, and are generally shaped as a rod.

The surfaces 45*a* and 46*a* (to be referred to as surfaces for welding hereinafter) of upper and lower frames 45 and 46 of aperture grill supporting frame 42, through which the aperture grill 41 is welded to the supporting frame, have been so processed as to give a part of a columnar wall surface with a radius of R as is seen from FIG. 1C, and FIG. 2A which gives an enlarged view of part A of FIG. 1C. Then, for example, on respective four points of the upper and lower frames 45 and 46 are applied pressures from a pressurizing mechanism 51 in the directions as indicated by arrows a and b of FIG. 1A so that the interval between the two frames may be reduced.

As a result, not only the upper frame 45 undergoes an elastic deformation in −Y direction as represented by the interrupted lines of FIG. 1A, but also the surfaces for welding 45*a* at its both ends experience elastic deformations in −Z direction with respect to the center of the frame, for example, as represented by the interrupted lines of FIG. 1C. Further, not only the lower frame 46 undergoes an elastic deformation in +Y direction as represented by the interrupted lines of FIG. 1A, but also the surfaces for welding 46*a* at its both ends experience elastic deformations in −Z direction with respect to the center of the frame, for example, as represented by the dotted lines of FIG. 1C. On the other hand, the side frame 47 undergoes an elastic deformation in +X and −Z directions as indicated by the interrupted lines of FIGS. 1A and 1B while the side frame 48 undergoes an elastic deformation in −X and −Z directions as indicated by the interrupted lines of FIGS. 1A and 1B. The aperture grill 41 is welded to the surfaces 45*a* and 46*a* for welding of the upper and lower frames 45 and 46 of aperture grill supporting frame 42 whose frames have been subject to such deformations as described above, and, after welding, the pressure from the pressurizing mechanism is released. As a result, the frames constituting the aperture grill supporting frame 42, being relieved of pressures which force them to undergo elastic deformations, try to return to original states through their intrinsic elasticity, and this action gives a tension to stretch the aperture grill 41 in Y-axis direction, or in a vertical direction, and hence the aperture grill 41 becomes a tautly stretched mask.

On this tautly stretched aperture grill 41 is placed a damper wire 43 as indicated by FIG. 2B to intersect the long axis of a slit at right angles, and its both ends are stretched by damper springs 44 fastened thereto. Here, the aperture grill 41 is welded to the upper and lower frames 45 and 46, while the latter are subject to elastic deformations, and, because these welded surfaces 45*a* and 46*a* with a form corespondent with a part of a columnar wall surface with a radius of R as described earlier are assembled as initially designed, the welded surfaces 45*a* and 46*a* being subject to elastic deformations do not actually give that designed form. Accordingly, forces N acting on the thin tapes constituting the aperture grill 41 are not uniform. Particularly at places where a gap c develops between the damper wire 43 and aperture grill 41, the force N pressing the aperture grill 41 in an axial direction is weakened or lost. Hence, frictional forces acting between the thin tapes and damper wires 43 will not become uniform, and not be able to give an anti-vibration effect uniformly over the whole surface of the aperture grill 41.

FIG. 3 gives a comparison of the surface shapes of the surfaces for welding surfaces 45*a* and 46*a* of upper and lower frames 45 and 46 before the aperture grill 41 is welded to them, and those of the same surfaces for welding 45*a* and 46*a* after welding. The surfaces for welding 45*a* and 46*a* before the aperture grill 41 is welded to them have the same shape with a part of a columnar wall surface with a radius of R, and the same surfaces 45*a* and 46*a* after the aperture grill 41 has been welded to them give a sector with a radius of R which has an indentation at each end.

Assume that the direction which the long sides of the aperture grill 41 supported by the pair of upper and lower frames 45 and 46 take is in an X-axis direction, the direction which the short sides of the aperture grill 41 take and is normal to X-axis direction is in a Y-axis direction, and the direction towards which an electron beam is discharged from the electron gun and is normal to X-axis and Y-axis directions is in a Z-axis direction.

SUMMARY OF THE INVENTION

This invention intends to provide an aperture grill supporting frame of which parts to support the aperture grill by stretching it take a form as represented by a part of a columnar wall surface with a radius of R after the aperture grill has been welded thereto, and which is so constructed that forces exerted by damper wires on thin tapes constituting the aperture grill may become uniform.

The aperture grill supporting frame of this invention is applied to an in-line cathode ray tube, and is used to support an aperture grill which has a grid of longitudinal slits. This aperture grill supporting frame consists of upper and lower frames to support the aperture grill by stretching it taut in a vertical direction, and left and right frames which are connected at both ends with the upper and lower frames. A pressure is applied onto the surfaces of upper and lower frames upon which the aperture grill is to be welded so as to reduce the interval between the upper and lower frames, and during the pressurization, the aperture grill is welded, and then the pressure is released. These elements are so processed from the beginning as to have sizes compensatory for deformations occurring as a result of pressurization and subsequent pressure release, and thus they will give a form like a part of a columnar wall surface with a predetermined radius, when they are relieved of pressure.

With the aperture grill supporting frame with above construction provided by this invention, the surfaces of upper and lower frames to which the aperture grill is welded take the form of a columnar wall surface after the aperture grill has been welded thereto.

BRIEF DESCRIPTION OF THE DRAWINGS

FIG. 1, consisting of FIGS. 1A through 1C, is frontal, lateral and bottom views of a conventional aperture grill supporting frame and aperture grill.

FIG. 6, consisting of FIGS. 6A through 6C, is frontal, lateral and bottom views of the aperture grill supporting frame of this invention and of an aperture grill.

DESCRIPTION OF THE PREFERRED EMBODIMENT

The aperture grill supporting frame of this invention and examples thereof will be detailed below with reference to the figures.

Figure 2A:
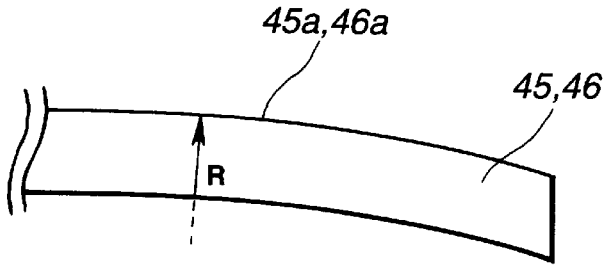
FIG. 2, consisting of FIGS. 2A through 2B, is an enlarged view of the terminal end of a lower frame of a conventional aperture grill supporting frame.
Figure 2B:
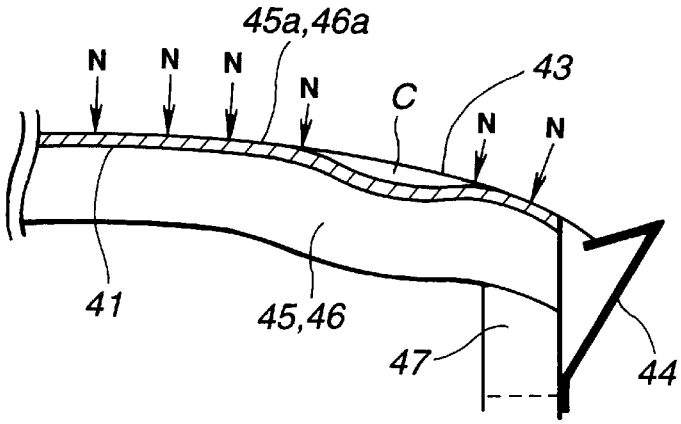
Figure 3A:
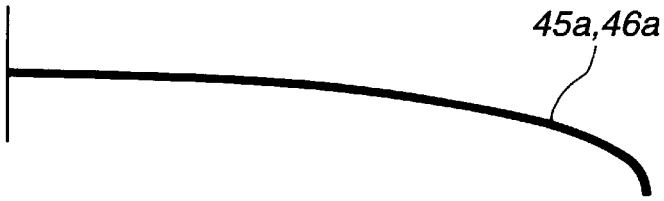
FIG. 3, consisting of FIGS. 3A through 3B, is a comparison of the surfaces for welding of the upper and lower frames of a conventional aperture grill supporting frame before and after welding.
Figure 3B:
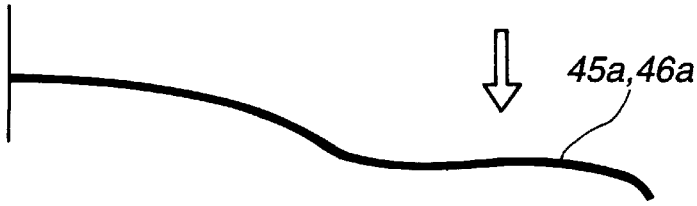
Figure 4:
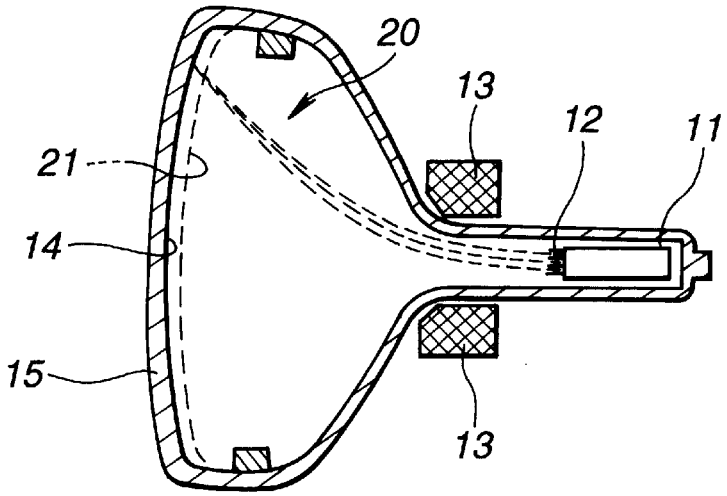
FIG. 4 is a sectional view of a cathode ray tube.

The in-line cathode ray tube is provided, as shown in FIG. 4, for example, with a three-beam electron gun 11 based on unit electron guns to emit three electron beams which are arranged in a horizontal line, a convergence electrode 12 to converge the electron beams emitted from the electron gun 11, a deflecting yoke 13 to deflect the electron beams, a color sorting mechanism 20 having an aperture grill 21 with a grid of longitudinal slits, and a glass bulb 15 which has a phosphor screen 14 which has its surface coated in longitudinal parallel lines with phosphors giving red, green and blue lights.

With this cathode ray tube, the electron beams emitted from the electron gun 11, after having been converged by the convergence electrode 12, are deflected by the deflecting yoke 13 in horizontal and vertical directions in synchrony with horizontal and vertical synchronization signals, and are scanned over the whole surface of the phosphor screen 14.

The electron beams which have been deflected by the deflecting yoke 13 have their unnecessary portion masked by the color sorting mechanism 20. Namely, the color sorting mechanism 20 passes only the fraction of electron beams which has been designed to be directed onto the phosphor screen 14. The electron beams having passed the color sorting mechanism 20 properly strike against red, blue and green phosphors of the phosphor screen 14, causing them to illumine to display a color image on the screen.

Next, the color sorting mechanism 20 will be described in detail below.

Figure 5:
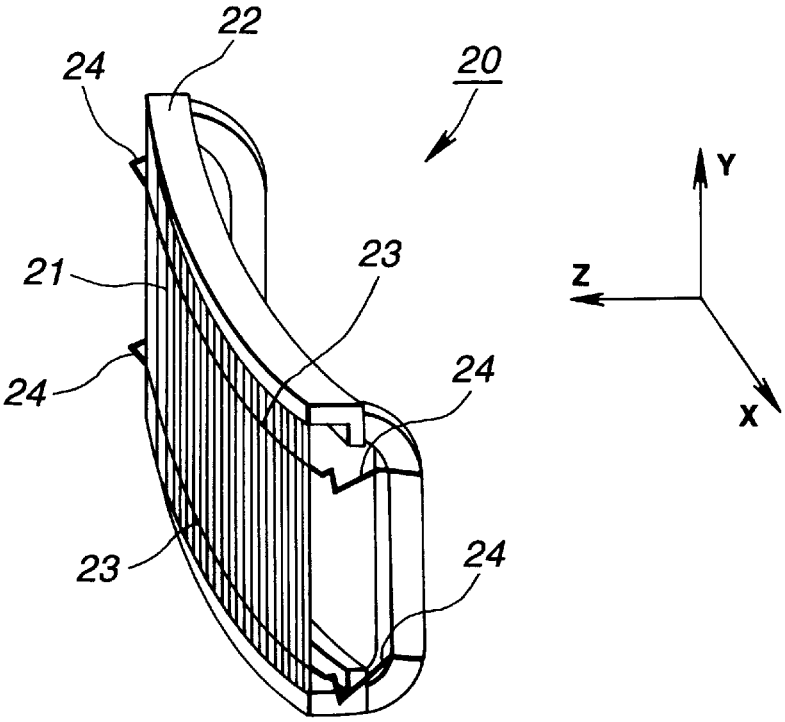
FIG. 5 is a perspective view of an aperture grill supporting frame of this invention.

The color sorting mechanism 20, as shown in FIG. 5, for example, consists of an aperture grill 21 which has a grid of longitudinal slits, an aperture grill supporting frame 22 which supports the aperture grill 21 by stretching it in a vertical direction, damper wires 23 each of which is placed in contact with a thin tape constituting the aperture grill 21 to give it an axially acting force, and damper springs 24 which stretch both ends of the damper wires 23 taut.

The aperture grill 21 is produced after a rolled plate material has been subject to photoetching to produce slits in the form of a grid of longitudinal lines, and parts between adjacent slits have been occupied by thin tapes. Namely, the aperture grill 21 takes the form of an assembly of thin tapes. As will be described later, this aperture grill 21 is connected by welding, while being kept stretched in a vertical direction or in a Y-axis direction, to the aperture grill supporting frame 22. Damper wires 23 are made of, for example, tungsten wire, and are placed such that their direction is normal to the long axes of slits of the aperture grill 21. Both ends of these damper wires 23 are stretched by the damper springs 24 mounted to the aperture grill supporting frame 22. By virtue of the tension from the damper springs 24, the damper wires 23 are placed in contact with individual thin tapes constituting the aperture grill 21 to give an axially acting force to each of the thin tapes. Thus, the damper wires 23 prevent the thin tapes of the aperture grill 21 from being put into vibration by, for example, a certain external vibrating source, through frictions generated by their contact with individual thin tapes. Namely, the damper wires 23 exert a uniformly acting anti-vibrating effect on the whole surface of the aperture grill 21 by giving uniformly acting frictions on individual thin tapes of the aperture grill 21.

FIG. 6 illustrates the aperture grill supporting frame 22 and aperture grill 21. FIG. 6A gives a frontal view of the aperture grill supporting frame 22 and aperture grill 21, FIG. 6B a lateral view of the aperture grill supporting frame 22, and FIG. 6C a bottom view of the aperture grill supporting frame 22 and aperture grill 21.

With respect to the color sorting mechanism of an in-line cathode ray tube, the aperture grill 21 is supported through tension by the aperture grill i.e., a supporting frame 22 (supporting base) which is subject to pressurization.

Then, description will be given of the aperture grill supporting frame 22.

The aperture grill supporting frame 22 consists, as shown in FIG. 6, for example, of upper and lower frames 25 and 26 which together support the aperture grill 21 by stretching it in a vertical direction, and side frames 27 and 28 which are connected to the upper and lower frames 25 and 26 at their ends. The upper and lower frames 25 and 26 have a cross-section in the form of an inverted L as shown in FIG. 6B, and are generally shaped as a rod. The surfaces 25*a* and 26*a* (to be referred to as surfaces for welding hereinafter) of upper and lower frames 25 and 26 are so processed as to give a part of a columnar wall surface with a predetermined radius after the aperture grill 21 has been welded thereto. Mounting of the aperture grill 21 to the aperture grill supporting frame 22 takes place as follows.

Figure 7A:
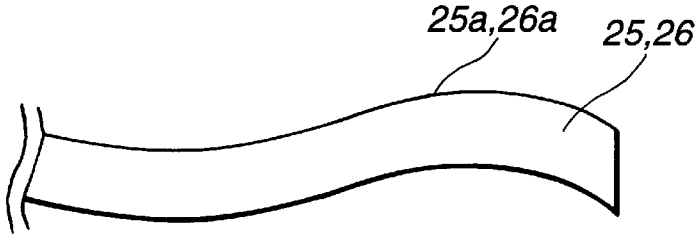
FIG. 7, consisting of FIGS. 7A through 7B, is an enlarged view of the terminal end of a lower frame of the aperture grill supporting frame of this invention.

The surfaces for welding 25*a* and 26*a* of upper and lower frames 25 and 26 of the aperture grill supporting frame 22 are so processed from the beginning as to have sizes compensatory for deformations occurring as a result of pressurization described later, and thus they will form a part of a columnar wall with a radius of R, as shown in FIG. 6C, and FIG. 7A where part A of FIG. 6C is enlarged for illustration. The surfaces for welding 25*a* and 26*a* at both ends, for example, take a slightly bulged form as compared with a sector with a radius of R before they are subject to welding, as shown in FIG. 7A. Then, for example, on respective four points of the upper and lower frames 25 and 26 are applied pressures from a pressurizing mechanism 31 in the directions as indicated by arrows a and b of FIG. 6A so that the interval between the two frames may be reduced.

As a result, not only the upper frame 25 undergoes an elastic deformation in a −Y direction as represented by the interrupted lines of FIG. 6A, but also the surfaces for welding 25*a* at its both ends experience elastic deformations in a −Z direction with respect to the center of the frame, for example, as represented by the interrupted lines of FIG. 6C. Further, not only the lower frame 26 undergoes an elastic deformation in +Y direction as represented by the interrupted lines of FIG. 6A, but also the surfaces for welding 26*a* at its both ends experience elastic deformations in a −Z direction with respect to the center of the frame, for example, as represented by the dotted lines of FIG. 6C. On the other hand, the side frame 27 undergoes an elastic deformation in +X and −Z directions as indicated by the interrupted lines of FIGS. 6A and 6B while the side frame 28 undergoes an elastic deformation in −X and −Z directions as indicated by the interrupted lines of FIGS. 6A and 6B. The aperture grill 21 is welded to the surfaces 25*a* and 26*a* for welding of the upper and lower frames 25 and 26 of aperture grill supporting frame 22 whose frames have been subject to such deformations as described above. After welding, the pressures from the pressurizing mechanism 31 are released. As a result, the frames constituting the aperture grill supporting frame 22, being relieved of pressures which force them to undergo elastic deformations, try to return to original states through their intrinsic elasticity, and this action gives a tension to stretch the aperture grill 21 in a Y-axis direction, or in a vertical direction, and hence the aperture grill 21 becomes a tautly stretched mask.

Figure 7B:
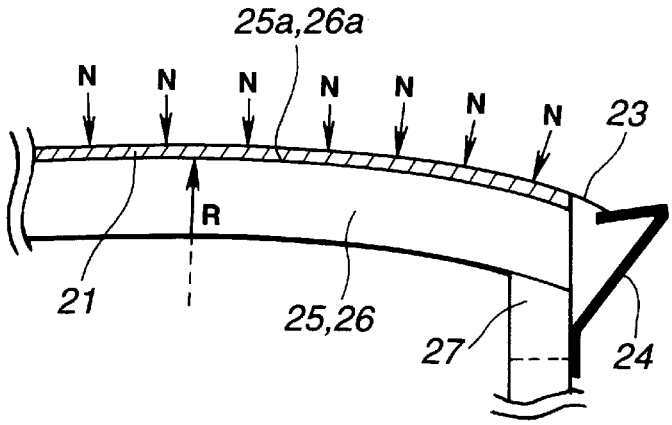

On this tautly stretched aperture grill 21, is placed a damper wire 23 as indicated by FIG. 7B to intersect the long axis of a slit at right angles, and its both ends are stretched by damper springs 24 fastened thereto. Because the aperture grill 21 is welded to the upper and lower frames 25 and 26, while the latter are subject to elastic deformations, the surfaces for welding 25*a* and 26*a* take the same form with that of a part of a columnar wall surface with a radius of R as described earlier, and forces N acting on the thin tapes constituting the aperture grill 21 are uniform. Accordingly, frictional forces acting between thin tapes and the damper wires 23 are uniform, and the aperture grill supporting frame 22 can exert a uniformly acting anti-vibration effect on the whole surface of aperture grill 21.

Assume that the direction which the long sides of the aperture grill 21 supported by the pair of upper and lower frames 25 and 26 take is an X-axis direction, the direction which the short sides of the aperture grill 21 take and is normal to X-axis direction is an Y-axis direction, and the direction towards which an electron beam is discharged from the electron gun 11 and is normal to X-axis and Y-axis directions is an Z-axis direction.

Figure 8A:
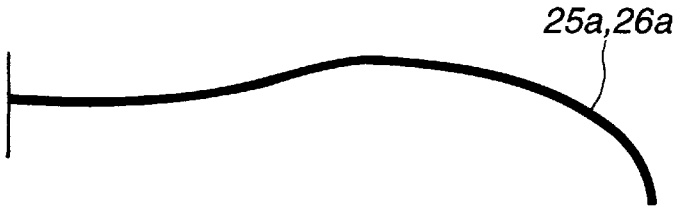
FIG. 8, consisting of FIGS. 8A through 8B, is a comparison of the surfaces for welding of upper and lower frames of the aperture grill supporting frame of this invention before and after welding.
Figure 8B:
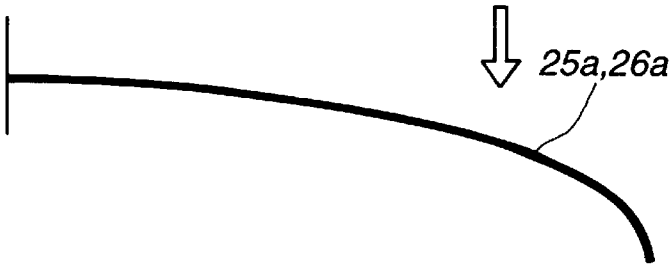

FIG. 8 gives a comparison of the shapes of the surfaces for welding 25*a* and 26*a* of upper and lower frames 25 and 26 before the aperture grill 21 is welded to them, and those of the same surfaces 25*a* and 26*a* after welding. The surfaces for welding 25*a* and 26*a* before the aperture grill 21 is welded to them give a sector with a radius of R which has a small bulge at each end, while the same surfaces 25*a* and 26*a* after the aperture grill 21 has been welded to them take the same form with that of a part of a columnar wall surface with a radius of R.

Figure 9:
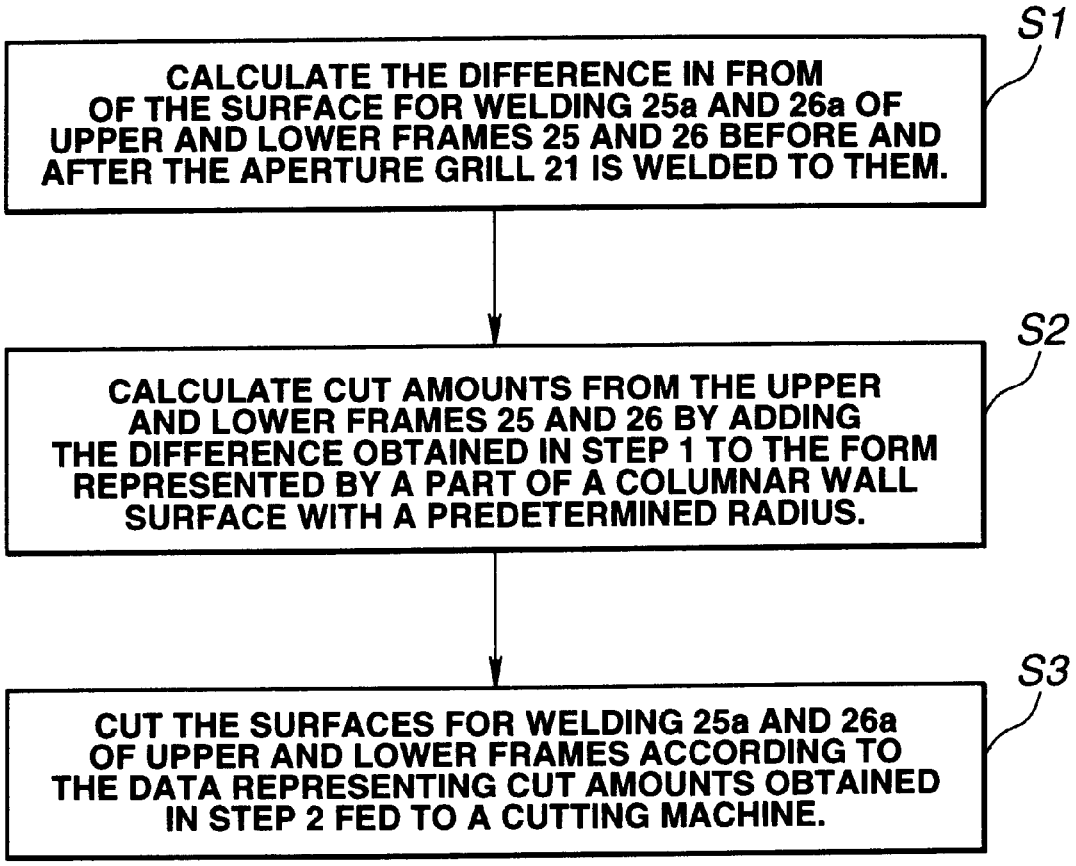
FIG. 9 is a chart representing the steps of the procedure for manufacturing the aperture grill supporting frame of this invention.

FIG. 9 gives a chart representing the steps of procedure for manufacturing the aperture grill supporting frame 22 of this invention.

In step 1, differences in form of the surfaces for welding 25*a* and 26*a* of upper and lower frames 25 and 26 before and after the aperture grill 21 is welded to them are calculated. Namely, calculated is the difference of the form the surfaces for welding 25*a* and 26*a* take when the aperture grill 21 is not welded to them, from the form the same surfaces for welding 25*a* and 26*a* will take when a pressure has been applied to the upper and lower frames 25 and 26 to reduce the interval between the two, the aperture grill been welded, and the pressure been released.

To be more specific, this difference is reproduced after the surfaces for welding are actually measured after a pressure has been applied to the frames, an n-th multi-term equation approximating the measurement is defined, and data representing cut amounts are fed to a cutting machine such as an NC miller for proper cutting.

As an alternative method based on data other than actual measurements, a simulation based on finite elements is possible where a structure analysis program is used to obtain a mode determining the deformations of the frames, and the resulting data are fed to a cutting machine such as an NC miller.

In step 2, the difference obtained in step 1 is added to the form corresponding to the part of columnar wall with a specified radius, to derive cut amounts appropriate for acquisition of desired surfaces for welding 25*a* and 26*a* of upper and lower frames 25 and 26.

In step 3, the data representing cut amount in step 2 are fed to a cutting machine such as an NC miller, and the surfaces for welding 25*a* and 26*a* of upper and lower frames 25 and 26 of the aperture grill supporting frame 22 are cut with the cutting machine.

According to this invention, while a pressure is applied to the upper and lower frames so as to reduce the interval between the two, the aperture grill is welded to the surfaces for welding of upper and lower frames, and then the pressure is released. These elements are so processed from the beginning as to have sizes compensatory for deformations occurring as a result of pressurization and subsequent pressure release, and thus they will take a form like a part of a columnar wall surface with a predetermined radius, when they are relieved of pressure. Thus, while the aperture grill is welded to the upper and lower frames being subject to elastic deformations, the welded surface takes the same form with that of a part of a columnar wall surface, and forces acting upon thin tapes constituting the aperture grill are uniform. Accordingly, frictional forces acting between the thin tapes and damper wires are constant, and can exert a uniform anti-vibration effect on the whole surface of aperture grill.

What is claimed is:

1. An aperture grill supporting frame which is to be incorporated into an in-line cathode ray tube, and is to support an aperture grill with a grid of longitudinal slits, comprising:

upper and lower frames for supporting said aperture grill by stretching it in a vertical direction; and left and right frames for connecting said upper and said lower frames at both ends thereof, wherein aperture grill welding surfaces of said upper and said lower frames, in advance of attaching said aperture grill, have an otherwise smooth curvature of a predetermined radius, and at least one bulging deformation in said otherwise smooth curvature, each bulging deformation creating an irregularity in said otherwise smooth curvature, bulging deformations being compensatory for pressurization when welding the aperture grill and subsequent pressure release, and thus cause said aperture grill welding surfaces to continuously form a part of a columnar wall with said predetermined radius when relieved of pressure.

2. The aperture grill supporting frame as set forth in claim 1, said frame having wires stretched substantially normal to a long axis of a grid of longitudinal slits on said aperture grill, and placed in contact with thin tapes constituting the aperture grill so as to exert axially directing forces on individual thin tapes.

3. The aperture grill supporting frame as set forth in claim 2 wherein said wires are damper wires each of which is placed in contact with a respective one of said thin tapes.

4. The aperture grill supporting frame as set forth in claim 2 further including damper springs which stretch both ends of the damper wires taut.

5. The aperture grill supporting frame as set forth in claim 1, further including damper wires supporting the aperture grill by stretching it in a vertical direction, each of which is in contact with a thin tape constituting the aperture grill to provide an axially acting force; and damper springs which stretch both ends of the damper wires taut, said damper wires placed such that their direction is normal to the long axes of slits of the aperture grill.

6. The aperture grill supporting frame as set forth in claim 1, wherein said left and right frames are side frames connected respectively to said upper and lower frames at their opposed ends.

7. The aperture grill supporting frame as set forth in claim 1 wherein said upper and lower frames each have a cross-section in the form of an inverted L and are generally shaped as a rod.

* * * * *